US008928464B2

(12) United States Patent
Claver

(10) Patent No.: US 8,928,464 B2
(45) Date of Patent: Jan. 6, 2015

(54) SAFETY CONTESTANT PROGRESS REGISTRATION

(76) Inventor: Bruce Claver, Glenview, IL (US)

( * ) Notice: Subject to any disclaimer, the term of this patent is extended or adjusted under 35 U.S.C. 154(b) by 625 days.

(21) Appl. No.: 12/710,988

(22) Filed: Feb. 23, 2010

(65) Prior Publication Data

US 2010/0227659 A1 Sep. 9, 2010

Related U.S. Application Data

(60) Provisional application No. 61/154,620, filed on Feb. 23, 2009.

(51) Int. Cl.
*H04Q 5/22* (2006.01)

(52) U.S. Cl.
USPC ..... 340/10.51; 340/10.1

(58) Field of Classification Search
CPC .. G04F 8/08; A63B 69/0028; A63B 24/0021; G07C 1/24
See application file for complete search history.

(56) References Cited

U.S. PATENT DOCUMENTS 5,293,354 A * 3/1994 Costabile ..... 368/11
5,511,045 A * 4/1996 Sasaki et al. ..... 368/2
6,072,751 A * 6/2000 Kirson et al. ..... 368/2
6,157,898 A * 12/2000 Marinelli ..... 702/141
6,496,806 B1 * 12/2002 Horwitz et al. ..... 705/28
6,617,963 B1 * 9/2003 Watters et al. ..... 340/10.41
6,669,600 B2 * 12/2003 Warner ..... 482/8
6,696,954 B2 * 2/2004 Chung ..... 340/572.7
6,707,381 B1 * 3/2004 Maloney ..... 340/568.1
7,057,975 B2 * 6/2006 Stobbe ..... 368/3
7,969,314 B2 * 6/2011 Boyd et al. ..... 340/573.1
8,179,233 B2 * 5/2012 Kia ..... 340/10.51
2003/0073518 A1 * 4/2003 Marty et al. ..... 473/416
2003/0163287 A1 * 8/2003 Vock et al. ..... 702/187
2004/0006445 A1 * 1/2004 Paek ..... 702/178
2005/0250440 A1 * 11/2005 Zhou et al. ..... 455/12.1
2008/0186166 A1 * 8/2008 Zhou et al. ..... 340/539.13
2009/0184806 A1 * 7/2009 Kia ..... 340/10.52
2009/0213700 A1 * 8/2009 Conant ..... 368/113

* cited by examiner

*Primary Examiner* — Masud Ahmed
(74) *Attorney, Agent, or Firm* — Miller, Matthias & Hull LLP

(57) ABSTRACT

A novel system and method provides an RFID tag usable to track a participant in a contest, wherein the RFID tag is permanently embedded into or onto a racing bib, also referred to as a timing bib. The embedding of the RFID tag into the timing bib serves to deter cheating and also enhances the usefulness of the timing bibs to the contest directors, sponsors or promoters. In another embodiment of the invention, the receiving antenna is situated such that participants move past it rather than over it, improving the reliability of the system.

1 Claim, 3 Drawing Sheets

SAFETY CONTESTANT PROGRESS REGISTRATION

RELATED APPLICATION

This application is related to and claims priority to U.S. Provisional Application 61/154,620 filed Feb. 23, 2009, entitled "Safety Contestant Progress Registration," which application is hereby incorporated by reference in its entirety for all that it expressly or inherently teaches, without exclusion of any portion thereof.

BACKGROUND OF THE INVENTION

When participants compete in a contest involving speed or distance, it is often necessary to note the times at which each participant crosses one or more thresholds. Such thresholds may include a starting line, a mile marker, a finish line, etc. As the number of participants increase, it becomes impractical to time each such participant by hand. As such, an accurate and automatic process is required in order to ensure that the progress of each participants is accurately timed.

It has been found to be effective in many cases to associate each participant with an RFID tag, e.g., a tag that emits a detectable signature signal that uniquely identifies the emitting tag. As the individual participant crosses each waypoint or other threshold, the unique RFID signature is detected and the time of detection is noted and stored, with the aid of a software program, e.g., in a computer or other device. Current mechanisms for associating RFID tags with participants, however, leave much to be desired.

For example, in many existing systems, each RFID tag is initially affixed to a bib. Each participant detaches the RFID tags from his or her race bib and attaches the tag to their shoes. However, this system has many disadvantages. First, the race bib incorporating a peel-off RFID tag is generally manufactured by attaching a temporary "sticker", or peel-off RFID label, designed to be removed. This tends to obscure and possibly damage other printed material on the bib, reducing the space usable for advertising and other important information. Secondly, the use of an RFID tag that separates from the bib encourages and allows cheating. For example, a weak participant may give his RFID tag to a more proficient competitor who is then able to log false times for the weaker contestant. This type of cheating allows the weak contestant to improperly qualify for races that they are not physically qualified to accomplish.

Moreover, even in the absence of intentional misconduct, the detachable RFID tag is prone to loss. For example, it may accidentally become detached from the user's shoe, wrist, or other supposedly secure location, leading the user to be disqualified.

Furthermore, the traditional RFID system includes a receiving antenna laying on the ground, e.g., under a mat or other covering, so that participants cross on top of it. This, however, makes the antenna vulnerable to damage, which can cause expense and inconvenience. Moreover, this configuration can cause unintentional injury to participants as they cross over or run over the mat. Additionally, by requiring the antenna to lay on the ground, existing systems cannot be used in other sporting events such as skiing, motocross, or even track and field.

Thus, an improved system of RFID provision and attachment is needed to minimize the detriments suffered by the prior art.

BRIEF SUMMARY OF THE INVENTION

The invention provides a system and method wherein an RFID tag usable to track a participant in a contest is permanently embedded into or onto a race bib. The embedding of the RFID tag into the race bib serves to deter cheating and also enhances the usefulness of the race bibs to the contest directors, sponsors or promoters. For example, with the RFID tag embedded as a part of the bib, interested parties can sell or otherwise use valuable advertising space on the bib, e.g., for the benefit of sponsors.

The RFID according to embodiments of the present invention can use either HF (high frequency) or UHF (Ultra high frequency) radio waves. This allows for a more robust system, in that a certain environment may be amenable to only one or the other of these signal types. Further, in an embodiment of the present invention, the receiving antenna is situated at one or more points above or adjacent to the threshold rather than laying on the ground, such that participants move past it rather than over it. Exemplary arrangements include placing the antenna vertically on one or both sides of the threshold and/or placing the antenna above the threshold at a height so as to allow the participants to pass underneath. This new configurations may improve the reliability of the antenna by preventing damage, thus avoiding missed times or expensive damage.

In a particular embodiment of the invention, a racing bib for timing a participant in a contest, includes a bib structure having one or more layers of material and an RFID tag permanently associated with the bib structure so as to be nonremovable in the ordinary course of use, whereby the bib structure is adapted to be mounted to the participant so as to associate the RFID tag with the participant.

In a further particular embodiment of the invention, a waypoint measurement post for measuring the passage of an object past a threshold, includes an RF antenna associated with the threshold, such that an object in proximity to the threshold is also in proximity to the antenna, and wherein the antenna is oriented so that it is not beneath the participants. The waypoint measurement post further includes a race monitor associated with the RF antenna, such that passage of an RFID tag by the threshold is detected by the antenna and relayed to the race monitor.

DETAILED DESCRIPTION OF THE INVENTION

The invention disclosed herein pertains to RFID technology, and in particular, pertains to a new system for providing and using RFID tags for timing purposes. In overview, the system according to an embodiment of the invention, an RFID tag is permanently embedded in or on a race bib, so that when the bib is worn by a participant, the passage of the bib by a measurement station serves to register the passage of the user by the measurement station. In a further embodiment of the invention, the measurement station includes a receiving antenna to detect the passage of an RFID tag, wherein the orientation of the receiving antenna or antennae is such that participants need not pass over the antenna.

According to a more specific embodiment of the invention, an active, passive, battery-assisted passive, or non-passive RFID tag is permanently embedded into or onto the material of a racing bib used at athletic events such as running, skiing, or biking. The RFID tag is designed to not be removed from the bib. Racing bibs may be printed with a number on the front to identify the athlete. The RFID tag is encoded with data that corresponds to or is usable to identify the number on the bib. An athlete wears the racing bib during their event and at certain access points, a receiver records the time the bib crosses the access point, thereby recording an accurate race time with respect to the athlete. A software program receives the RFID data and records said data and transforms it into race results, e.g., race times.

Figure 1:
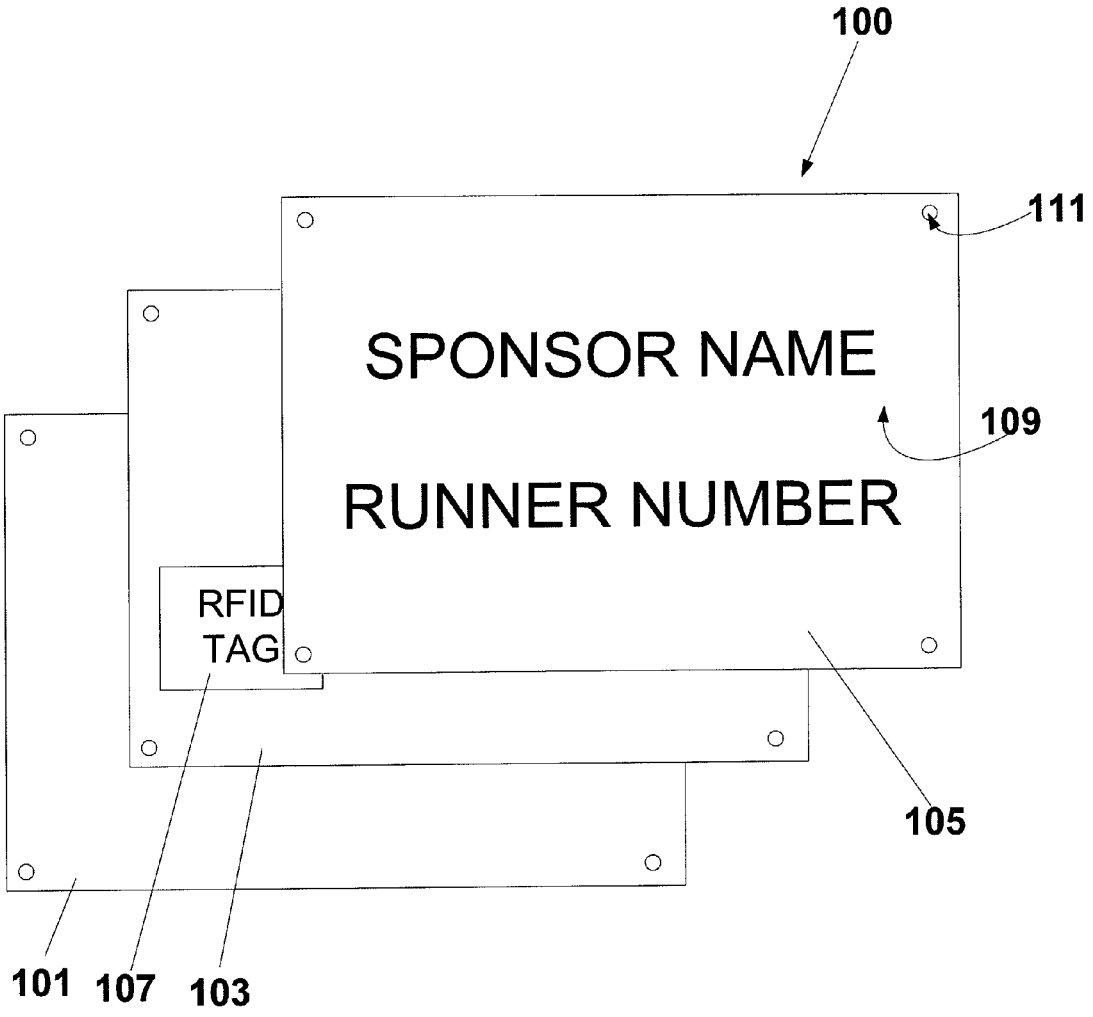
FIG. 1 is a front partial cut away view of race bib having an embedded RFID tag according to an embodiment of the invention.

Referring now to the drawings, wherein like elements reference like parts for ease of understanding, FIG. 1 is a schematic cut-away view of a racing bib 100 according to an embodiment of the invention. In the illustrated example, the racing bib 100 includes a plurality of layers, including a substrate layer 101, a middle layer 103, and a top layer 105. The number of layers is not critical, and an implementation of the invention may use a lesser or greater number of layers without departing from the scope of the invention. The layers 101, 103, 105, may be made of any suitable material or materials, including plastic, vinyl, paper, cardboard, etc. The layers 101, 103, 105 may be of the same or different construction. The bib 100 may be assembled via any known industrial process, including adhesion, lamination, sewing, etc.

An RFID tag 107 is associated with one of the layers 101, 103, 105. In the illustrated embodiment of the invention, the RFID tag 107 is associated with the middle layer 103, and may or may not even be externally visible. In another embodiment of the invention, the RFID tag 107 is externally visible, such as may be the case if the RFID tag 107 is associated with the top layer 105. However, in any case, the RFID tag 107 is permanently affixed to or within the racing bib 100. In an example, the RFID tag is affixed to or embedded within a single layer.

In an embodiment of the invention, the RFID tag 107 is applied to the bib 100 by way of magnetic and/or conductive ink or paint, such that a layer of the bib 100 itself forms a substrate for the RFID tag 107. In this way, the RFID tag 107 may be applied more efficiently, and may also be more difficult to separate from the bib 100. Suitable conductive and magnetic inks are commercially available and will not be discussed at length herein.

A front surface 109 of the top layer 105 of the bib 100 provides an area for printed matter or other visual matter. For example, a race number identifying the athlete may be shown, as well as printed advertising or promotional material. Because the RFID tag is disposed as part of the racing bib 100, and is not removable, the printed matter on the front face 109 may overwrite the area wherein the RFID tag 107 is located without the risk that part of the printed matter will be lost by removal of the RFID tag 107.

The racing bib 100 is intended to be worn by an athlete. To this end, one or more holes 111 may be provided so that the racing bib 100 can be attached to the individual in a relatively secure manner.

Figure 2:
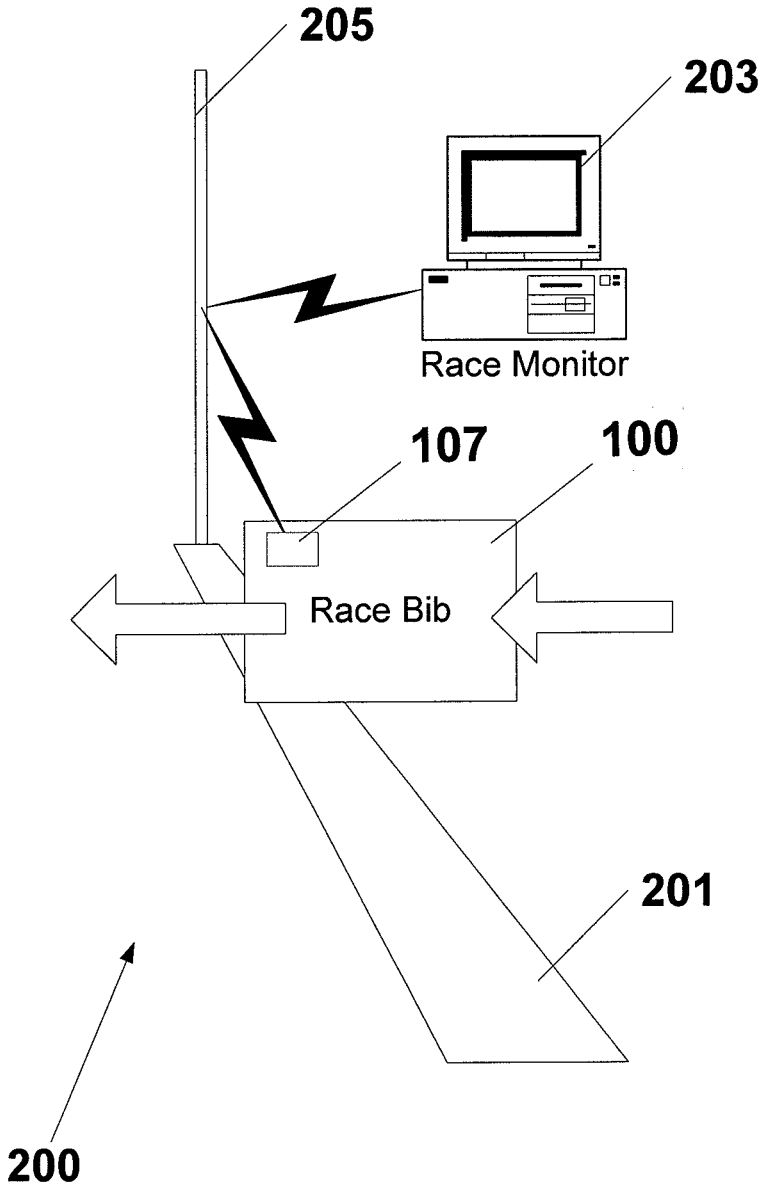
FIG. 2 is a perspective side view of a waypoint measuring system according to another embodiment of the invention.

Referring now to the illustration of FIG. 2, there is shown a waypoint setup 200 including the components used to register the crossing of the race bib 100 (i.e., when a runner crosses). In particular, the waypoint setup 200 includes a threshold 201, e.g., a finish line etc., that may or may not be visible. An antenna 205 is associated with the threshold 201, so that a crossing detected by the antenna 205 can be interpreted as a crossing of the threshold 201.

It should be noted that in this embodiment the antenna 205 is oriented vertically so that the contestants pass by, but not over, the antenna 205. The antenna 205 may be self supporting or may be associated with a support structure, e.g., a fiberglass or plastic rail or tube. Although the foregoing discussion identifies a single antenna, two or more antennae are used in another embodiment of the invention, with one antenna being disposed on each side of the course such that contestants pass between the antennae.

A race monitor 203 associated with the antenna 205 serves to receive crossing data and transform such data into human usable statistics, i.e., race times, etc. The race monitor 203 may be a computer such as a PC or workstation, or may be a plurality of computing devices networked together.

When the race bib 100 crosses the threshold 201, e.g., comes in close proximity to antenna 205, the RFID tag 107 in the bib 100 is detected by the antenna 205. The manner of detection is via electromagnetic radiation (radio waves) as discussed above, and need not occur at any particular portion of the RF spectrum.

The antenna 205 then transmits the detected data to the race monitor 203. The mode of transmission between the antenna 205 and the race monitor 203 may be wireless, wired, and so on. In general the data detected by the antenna 205 serves to identify the runner or other athlete, while the time of transmission of that data to the race monitor 203 serves to establish the time of crossing. These two pieces of data are stored and used to generate the necessary statistics, discussed above.

Figure 3:
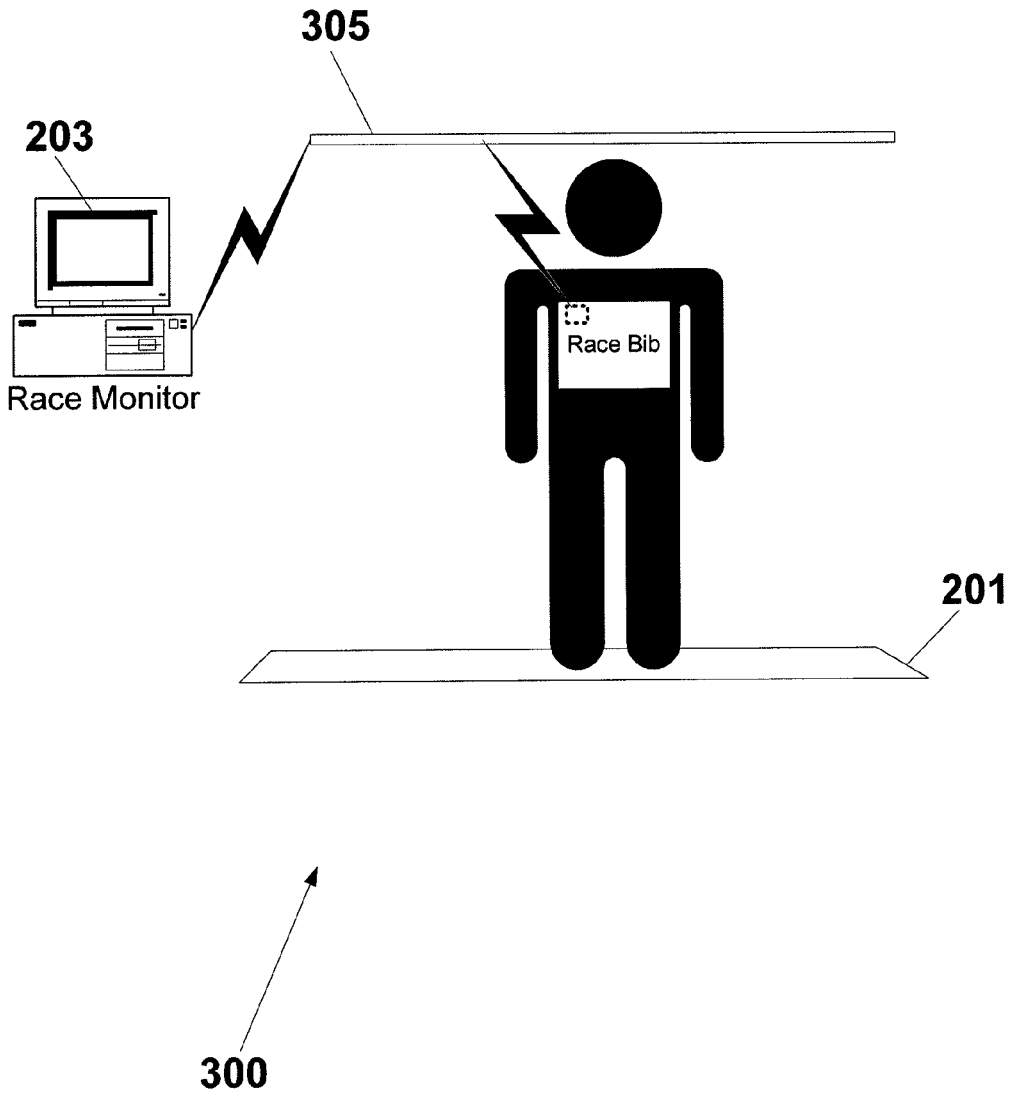
FIG. 3 is a perspective side view of an alternative waypoint measuring system according to another embodiment of the invention.

In an alternative embodiment of the invention, illustrated as configuration 300 of FIG. 3, the antenna 305 is located above the threshold 201. In this embodiment, participants (301) pass beneath the antenna 305.

Due to the need to precisely time the crossing of the threshold 201, the RFID tag 107 is relatively short range. In the prior systems, the closeness of the tag (i.e., on the user's shoe) to the antenna provided a sufficient guarantee that the crossing was detected at the appropriate time. In an embodiment of the invention, the tag 107 may detected at longer range to account of the fact that it may not come within several inches of the antenna at crossing. In order to ensure that the crossing is nonetheless accurately timed, an algorithm implemented on race monitor 203 may derive the crossing time based on the maximum signal strength from the tag 107. Other algorithms to detect the crossing may instead be used if desired.

It will be appreciated that a new and useful system of using and provisioning an RFID tag timing mechanism is disclosed herein. All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A waypoint measurement post for measuring the passage of an object past a threshold, the waypoint measurement post comprising: an RF antenna associated with the threshold, such that an object in proximity to the threshold is also in proximity to the antenna, and wherein the antenna is oriented vertically beside the threshold so that the object does not pass over the antenna while passing the threshold; and a race monitor associated with the RF antenna, such that passage of an RFID tag by the threshold is detected by the antenna and relayed to the race monitor; wherein the RF antenna associated with the threshold comprises two separate antenna and the two separate antenna are located at opposite lateral sides of the threshold.

* * * * *